US005106312A

United States Patent [19]

Yeh

[11] Patent Number: 5,106,312

[45] Date of Patent: Apr. 21, 1992

[54] COAXIAL CABLE OUTPUT TERMINAL SAFETY PLUG DEVICE

[76] Inventor: Ming H. Yeh, No. 2, Lane 8, Hsin An Road, Shih Lin District, Taipei, Taiwan

[21] Appl. No.: 722,318

[22] Filed: Jun. 27, 1991

[51] Int. Cl.[5] ..... H01R 13/44

[52] U.S. Cl. ..... 439/133; 439/307; 439/620

[58] Field of Search ..... 439/133, 304, 305, 306, 439/307, 308, 309, 620; 333/22 R

[56] References Cited

U.S. PATENT DOCUMENTS 3,845,454 10/1974 Hayward et al. ..... 439/307
3,890,028 6/1975 Blanchenot ..... 439/133
4,469,386 9/1984 Ackerman ..... 439/304 X
5,011,422 4/1991 Yeh ..... 439/307

*Primary Examiner*—Neil Abrams
*Assistant Examiner*—Khiem Nguyen
*Attorney, Agent, or Firm*—Bacon & Thomas

[57] ABSTRACT

A coaxial cable output terminal safety plug device which is screwed with a conventional coaxial cable output terminal to prevent unauthorized use, wherein the safety plug device includes a hollow plug receiving a plug seat therein, and if the plug is rotated alone, then the plug seat can not be driven and screwed and therefore a special tool is used to drive the plug and screw or unscrew the same from the output terminal, the plug seat being formed with an output hole for insertion of a resistor for matching impedance.

2 Claims, 5 Drawing Sheets

COAXIAL CABLE OUTPUT TERMINAL SAFETY PLUG DEVICE

BACKGROUND OF THE INVENTION

The present invention relates to a coaxial cable output terminal safety plug device for use in cable television systems (CATV), subscription television systems (STV) and master antenna TV systems (MATV) to releasably block up any signal output terminal which is not in use.

Regular cable television systems generally utilize coaxial cable to transmit audio signal to subscribers. Therefore, transformer of multiple output terminals and impedance matching and amplifying device must be used so that audio signal can be transmitted to each subscriber through coaxial cable. Because the number of subscribers is generally not equal to the number of output terminals. Therefore, a plug which has an impedance matching device must be used to block up each output terminal which is not in use, so as to eliminate impedance matching problem between signal output coaxial cable and subscriber's coaxial cable.

The conventional plug which is used to block up a coaxial cable output terminal may be easily removed from an output terminal and a non-subscriber can easily connect an output terminal to a TV without paying any fee. Therefore, there is developed a kind of safety plug which requires a special tool to fastened in or remove from a coaxial cable signal output terminal and can effectively protect from piracy. However, this type of safety plug is expensive and easy to damage.

SUMMARY OF THE INVENTION

It is the object of the present invention to provide a safety plug device for coaxial cable output terminal, which is easily manufactured at low cost and with simple structure. According to the preset invention. the safety plug device comprises a plug and a plug seat and a drive pipe coaxially arranged in the plug. A resistor fixing hole is formed at front end of said plug seat for receiving a 75 $\omega$ resistor which is soldered therein. A special tool can be inserted into the plug and rotated therewithin. A movable protrusion is formed at front end of the tool to be inserted into the plug and engaged with a saw tooth portion formed at front end of the drive pipe to make a rear female thread of the drive pipe screw with an output terminal with the resistor right inserted in the output hole. At this time, if the plug is rotated alone without using special tool, then the drive pipe can not botain sufficient axial force to drive the plug seat so that the plug will idle and can not be unscrewed or screwed.

Further objects and advantages of the invention will be apparent from a reading of the following detailed description, taken in conjunction with the figures of the accompanying drawings, in which:

DETAILED DESCRIPTION OF THE PREFERRED EMBODIMENT

Figure 1:
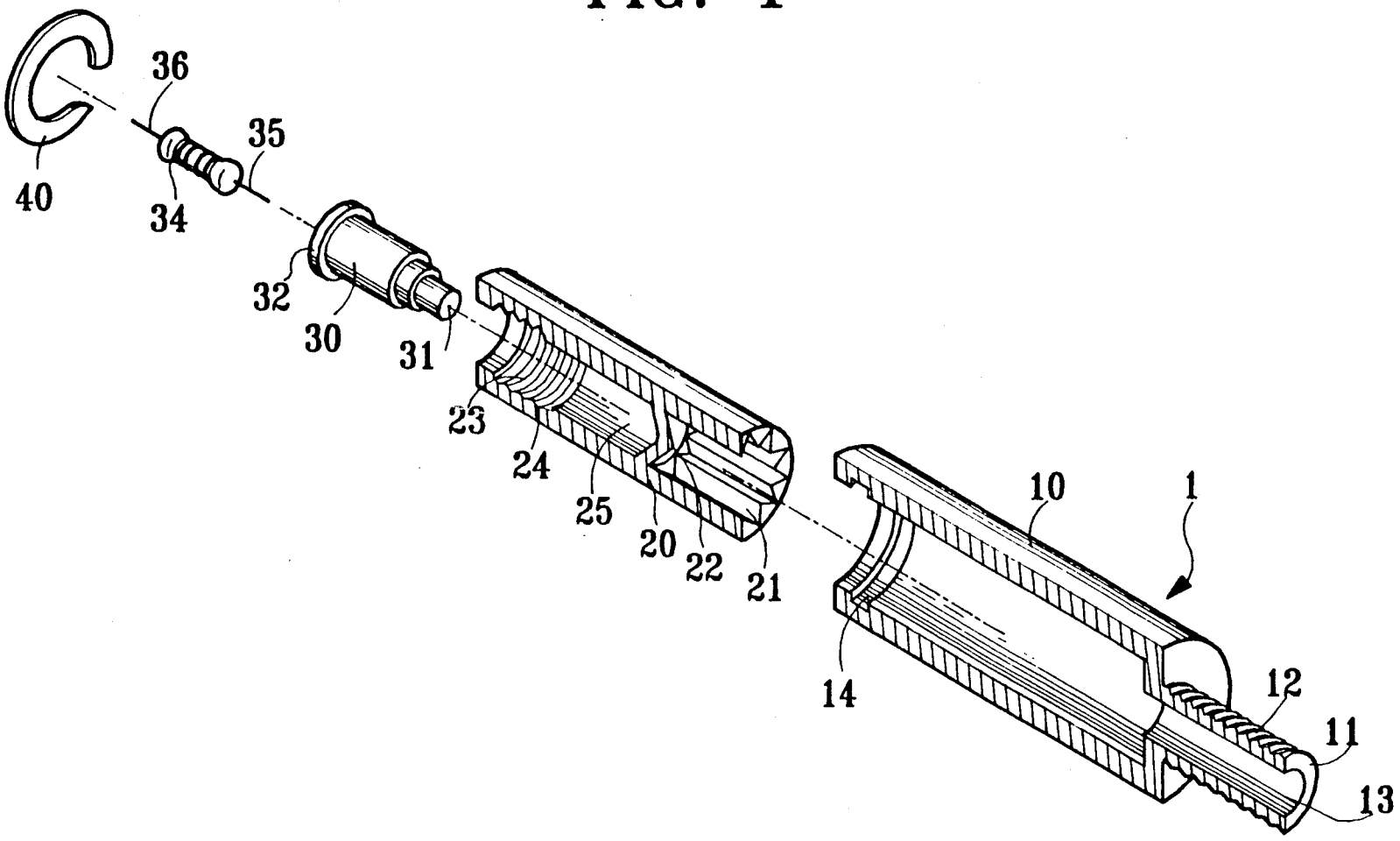
FIG. 1 is a perspective exploded view of a preferred embodiment of this invention.
Figure 2:
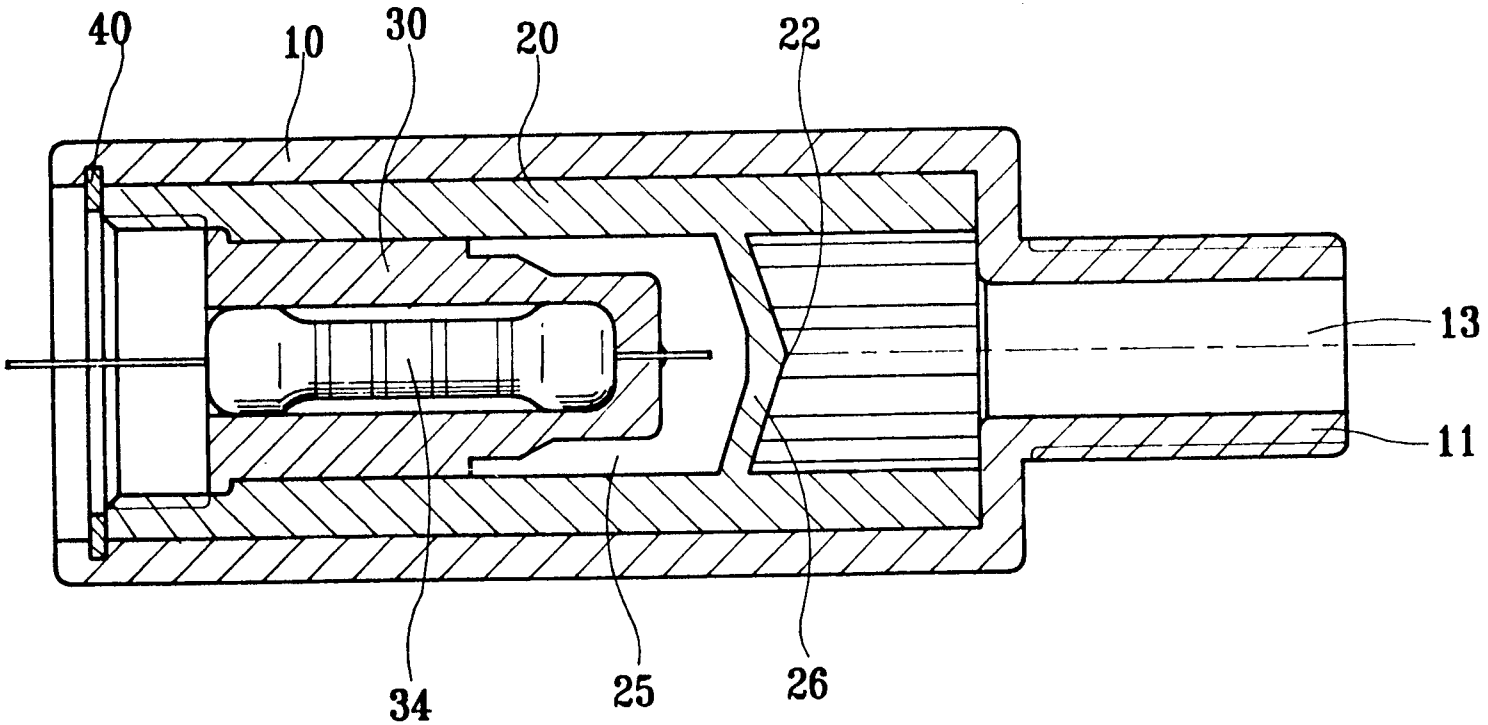
FIG. 2 is a sectional view of the plug thereof.

Please refer to FIGS. 1 through 5. The present invention includes a plug 1 and a tool 5. The plug 1 is generally composed of a round tube 10 having a front end wall formed with an annular groove 14. The round tube 10 has a rear end 10 formed with a cylinder projection 13 which is disposed with male thread 12 and an axial through hole 13.

Between the annular groove 14 and projection 11, a drive pipe 20 and a plug seat 30 are coaxially received in the round tube 10, wherein a saw tooth portion 21 is disposed inside one end of the drive pipe 20, and a female thread 23 is disposed inside the other end of the drive pipe 20 to screw with a thread 60 of a coaxial cable output terminal hole. A step portion 24 is disposed at front end of the female thread 23. A blind fixing hole 25 is disposed at front end of the step portion 24. Between the fixing hole 25 and saw tooth portion 21 is formed a compartmentalizing wall 26. The compartmentalizing wall 26 has a conic portion 22 adjacent to the saw tooth portion 21. The plug seat 30 has three step portions. A resistor fixing hole 31 is disposed on an end face of a step portion with smallest diameter. A flange 32 is disposed along the circumference of a step portion with largest diameter. A blind receiving hole 33 is axially disposed thereon whereby a 75 Ω 0.5 watt resistor 34 can be placed in the receiving hole 33 of the plug seat 30. A front lead pin 35 of the resistor 34 penetrates through a resistor fixing hole 31. The lead pin 35 is soldered in the fixing hole 31. The plug seat 30 with soldered resistor 34 is riveted in the fixing hole 25 of the drive pipe 20 with the flange 32 abutting against the step portion 24. Then an open spring 40 is placed in the annular groove 14 of the round tube 10 to abut against the drive pipe 20 and be fixed in the plug 1. A rear lead pin 36 of the resistor 34 protrudes beyond the front end of the drive pipe 20 whereby when the drive pipe 20 screws with the output terminal 6, the rear lead pin 36 can be inserted in a signal output hole 61.

Figure 3:
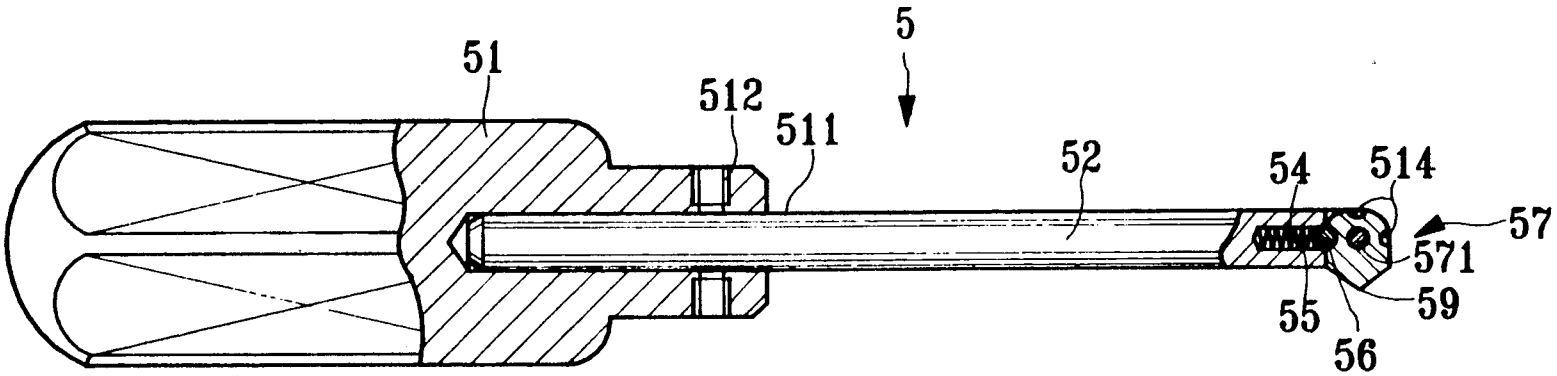
FIG. 3 is a partially sectional view of the tool thereof.
Figure 4:
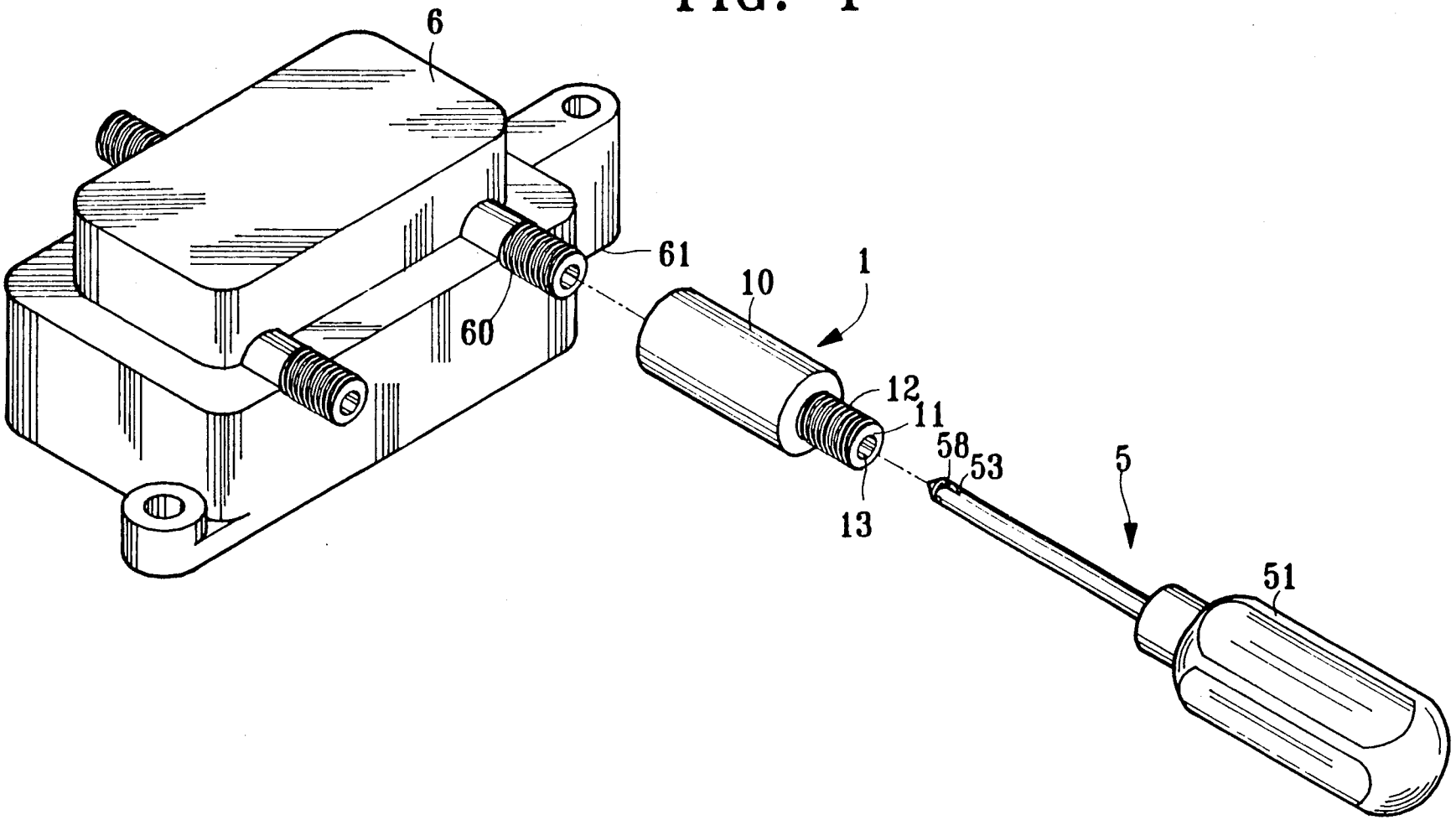
FIG. 4 is a perspective exploded view of plug and output terminal of this invention.
Figure 5:
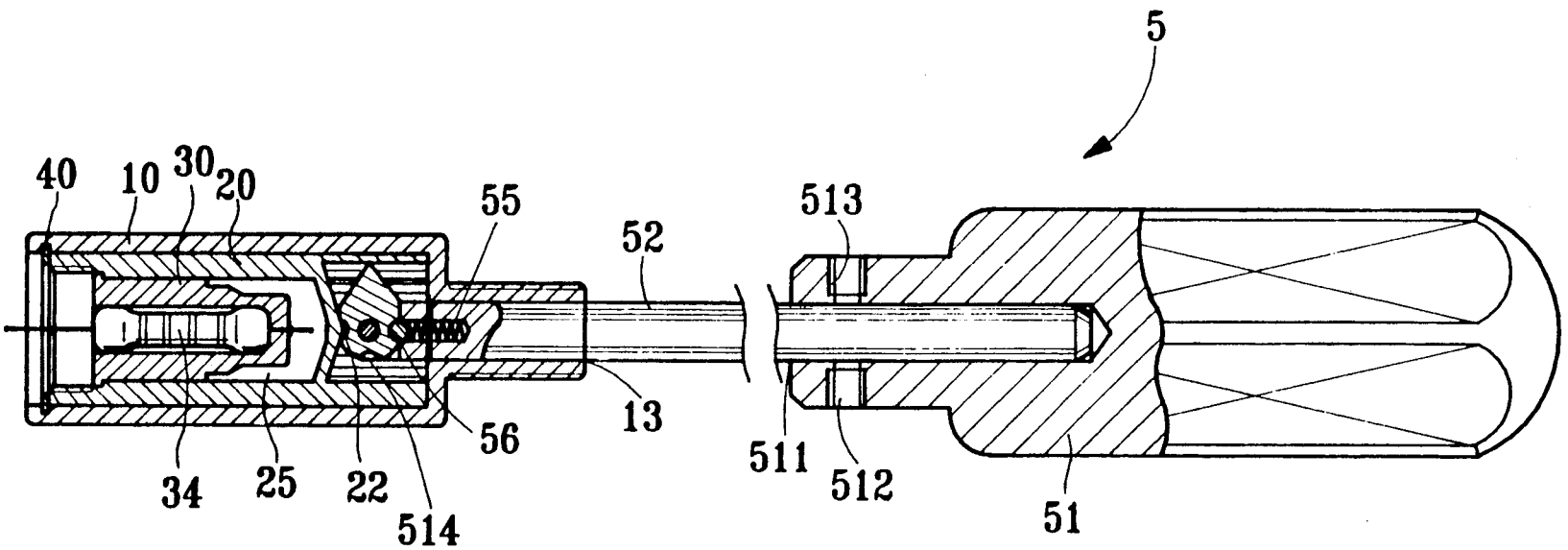
FIG. 5 is a sectional view of the tool which is inserted in the plug of this invention.

A specific tool 5 according to the present invention as shown in FIG. 3 includes a handle 51 and a stem 52. A mortise hole 53 is formed at one end of the stem 52. A blind hole 54 with proper length is axially formed in the mortise hole 53. A compression spring 55 is placed into the blind hole 54 and a ball member 56 is disposed at front end of the compression spring 55. A movable protrusion 57 has a tenon 58 at its one end and a sharp conic head 59 at its other end to cooperate with the saw tooth portion 21. The tenon 58 can be placed into the mortise hole 53 and an insert pin 571 pivotably connects the tenon 58 and mortise 53 to form a pivot device so that the movable protrusion 57 can be pivoted toward two sides. On three faces of the protrusion 57 are disposed recesses 514 cooperating with the ball member 56 whereby when the protrusion 57 is pivoted, the recesses 514 can engage with the ball member 56. The other end of the stem 52 is inserted into the blind hole 511 of the handle 51 and locked in the female thread 513 by means of a thread body 512 so that the stem 52 is secured to the handle 51.

In operation, the tool 5 is inserted into the through hole 13 of the round tube 10. The sharp conic head 59 of the stem 52 touches the comic portion 22 and 90° inclines, making the sharp conic head 59 engage with any of the teeth of saw tooth portion 21. The conic portion 22 just abuts against the recess 514 of the movable protrusion 57 so that the tool 5 can be conveniently inserted and rotated and provide sufficient axial force, making the sharp conic lead 59 engage with the saw tooth portion 21 without slipping. When pulling out the tool 5, it can be lightly directly pulled out, making the inclined movable protrusion 57 restore to its original coaxial position for next insertion.

As indicated, the structure herein may be variously embodied. Recognizing various modifications will be apparent, the scope hereof shall be deemed to be defined by the claims as set forth below.

What is claimed is:

1. A coaxial cable output terminal safety plug device comprising:

a plug composed of a round tube having a front end wall formed with an annular groove, said round tube having a rear end formed with a cylinder projection which is disposed with male thread and an axial through hole;

a drive pipe coaxially received in said round tube, a saw tooth portion being disposed inside one end of said drive pipe, a female thread being disposed inside the other end of said drive pipe, a step portion being disposed at front end of said female thread, a blind fixing hole being disposed at front end of said step portion, between said fixing hole and saw tooth portion being formed a compartmentalizing wall, which has a conic portion adjacent to said saw tooth portion;

a plug seat disposed in said fixing hole of said drive pipe, having three step portions, a resistor fixing hole being disposed on an end face of a step portion with smallest diameter, a flange being disposed along the circumference of a step portion with largest diameter, a blind receiving hole being axially disposed therethrough whereby a resistor can be placed in said receiving hole of said plug seat, a front lead pin of said resistor penetrating through a resistor fixing hole and being soldered therein;

an open spring disposed in said annular groove of said plug; and a tool adapted to be inserted into said through hole of said plug, including a handle and a stem, a mortise hole being formed at one end of said stem, a blind hole with proper length being axially formed in said mortise hole, a compression spring being placed into said blind hole and a ball member being disposed at front end of said compression spring, a movable protrusion having a tenon at its one end and a sharp conic head at its other end to cooperate with said saw tooth portion, said tenon being suitable to be placed into said mortise, an insert pin pivotably connects said tenon and mortise to form a pivot device so that said movable protrusion can be pivoted toward two sides.

2. A safety plug device as claimed in claim 1, wherein on three faces of said protrusion are disposed recesses cooperating with said ball member.

* * * * *